US006598418B2

(12) United States Patent
Holley, Jr.

(10) Patent No.: US 6,598,418 B2
(45) Date of Patent: Jul. 29, 2003

(54) BEVERAGE CONTAINER WITH DETACHABLE COOLING/MIXING ELEMENT

(75) Inventor: James W. Holley, Jr., Colorado Springs, CO (US)

(73) Assignee: Insta-mix, Inc., Colorado Springs, CO (US)

( * ) Notice: Subject to any disclaimer, the term of this patent is extended or adjusted under 35 U.S.C. 154(b) by 0 days.

(21) Appl. No.: 09/942,073

(22) Filed: Aug. 28, 2001

(65) Prior Publication Data

US 2003/0041618 A1 Mar. 6, 2003

(51) Int. Cl.[7] ..... F25D 3/08
(52) U.S. Cl. ..... 62/457.3; 62/457.4
(58) Field of Search ..... 62/457.4, 457.3, 62/372

(56) References Cited

U.S. PATENT DOCUMENTS 3,704,803 A * 12/1972 Ponder ..... 215/11.2
4,545,491 A * 10/1985 Bisgaard et al. ..... 215/11.5
4,865,207 A * 9/1989 Joyner et al. ..... 215/11.1
4,869,381 A * 9/1989 Agner ..... 215/11.1
4,981,022 A * 1/1991 Snyder ..... 62/457.3
5,244,122 A * 9/1993 Botts ..... 222/158
5,467,877 A * 11/1995 Smith ..... 62/457.3
5,555,741 A * 9/1996 Oakley ..... 222/5
5,678,709 A 10/1997 Holley et al.
5,685,447 A * 11/1997 Springett et al. ..... 215/11.1
5,692,627 A * 12/1997 Feng ..... 215/11.4
6,123,065 A * 9/2000 Teglbjarg ..... 126/262
6,134,894 A * 10/2000 Searle et al. ..... 62/372

* cited by examiner

*Primary Examiner*—William E. Tapoloai
*Assistant Examiner*—Mohammad M. Ali
(74) *Attorney, Agent, or Firm*—Bever, Hoffman & Harms, LLP; Patrick T. Bever

(57) ABSTRACT

A beverage container including a body and a lower cap having a cooling element mounted thereon that extends into an interior portion of the body. The lower cap is removable for convenient charging (e.g., freezing) of the cooling element. The lower cap is then attached to the body and liquid is inserted into the body through an upper opening. A mixing fixture is integrally formed on the free end of the cooling element, and is used to mix the cooled liquid stored in the body with a powdered substance entered through the upper opening. In one embodiment, the beverage container is a multi-chambered container that includes a rotatable hollow member for storing the powdered substance, and a housing for securing the hollow member to the body such that a curved wall of the hollow member separates the powdered substance from the cooled liquid stored in the body.

20 Claims, 3 Drawing Sheets

BEVERAGE CONTAINER WITH DETACHABLE COOLING/MIXING ELEMENT

FIELD OF THE INVENTION

The present invention relates to rigid containers, and in particular to containers for storing cold nutritional beverages that are mixed immediately before consumption.

RELATED ART

Many modern nutritional and dietary supplements are produced as powders that are mixed with a liquid (e.g., water, milk, or juice) immediately before consumption. Typically, the powder/liquid mixture is best if consumed cool (i.e., below room temperature). Therefore, the liquid must be cold before the mixing with the powder to produce a cool powder/liquid mixture immediately after the mixing process. Further, because the liquid is cold at the time of mixing, the powder/liquid mixture must be shaken or stirred vigorously to sufficiently dissolve the powder into the liquid.

Powdered nutritional and dietary supplements are consumed in a variety of locations, such as work or a gymnasium, that typically do not provide kitchen facilities (e.g., refrigerators and counter space) for cooling the liquids and mixing the liquid with the powdered supplement. In these situations, the liquid is often pre-cooled and then stored in a beverage container that is insulated, or is stored in an insulated box. The insulation maintains the liquid at a desired temperature for a few hours, but is bulky and inconvenient to carry. At the time of consumption, the powdered material is poured by hand through an opening of the beverage container, thereby exposing both the powder and the cooled liquid to air-born contaminants and increasing the risk of spillage. After pouring the powder into the liquid, the beverage container is closed and shaken until mixing is completed.

U.S. Pat. No. 5,678,709, which is owned by the assignee of the present invention, discloses a multi-chambered substance containment apparatus that includes a base portion for storing a liquid and a rotatable hollow member for storing a powdered substance such that the powdered substance is separated from the liquid by the wall of the hollow member. At a desired time, the hollow member is rotated relative to the chamber, and an opening in the hollow member is aligned with an opening in the base portion, thereby allowing the powdered substance and liquid to mix. The multi-chambered substance containment apparatus thereby avoids the mess and potential contamination that occur when powdered substances are poured into a single chamber container at inconvenient locations.

A problem with the use of multi-chambered containers, such as those disclosed in U.S. Pat. No. 5,678,709 (discussed above), for storing nutritional and/or dietary powders is that they do not provide adequate insulation for keeping liquid cool for long periods of time. Possible solutions to this problem would be to insulate the base portion of the multi-chambered container, or to provide an insulated box or wrap that surrounds the base portion. However, all of these solutions would be excessively bulky, and would not optimally retain the fluid in a cooled state.

What is needed is a beverage container that is capable of storing cold liquids for an extended period of time without the need for insulation. What is also needed is a beverage container that facilitates the mixing of powdered substances and liquid, and is easy to clean.

SUMMARY

The present invention is directed to a beverage container for storing cooled liquids that are subsequently mixed with powdered substances. In accordance with a first aspect of the present invention, the beverage container includes an elongated cooling element that is removable for convenient charging (e.g., freezing), and, when attached, is located inside of the beverage container such that the elongated cooling element is surrounded by the liquid to be cooled. In accordance with a second aspect of the present invention, the beverage container includes a mixing fixture that is mounted on the elongated cooling element such that the mixing fixture is positioned in a central portion of the container, thereby facilitating thorough mixing of the cooled liquid and a powdered substance immediately before consumption.

In accordance with a disclosed embodiment, a multi-chambered beverage container includes a body defining a chamber for storing liquid that is accessible through a first (lower) opening and a second (upper) opening, and a hollow member for storing a powdered substance that is movably mounted over the second (upper) opening formed in the body. A lower cap is mounted over the first (lower) opening formed in the body. The hollow member includes a curved (e.g., spherical) wall and is moveable between a first position in which a portion of the curved wall is disposed to block the second opening of the body such that the liquid chamber is separated from the powdered substance, and a second position in which the second opening aligns with a third opening provided in the hollow member to form a passage between the interior of the body and the interior of the hollow member, thereby allowing the liquid to mix with the powdered substance.

In accordance with the first aspect, an elongated cooling element is mounted on the lower cap and extends into the liquid chamber formed by the body. The lower cap and cooling element are detachable for convenient cleaning and charging (e.g., freezing), and then re-attached immediately before a liquid is poured into the liquid chamber. Because the cooling element can be separated from the remainder of the beverage container, a minimum amount of space is required for charging. Further, because the cooling element extends into the body and is surrounded by the liquid, a highly efficient system is formed that maximizes the cooling capabilities of the cooling element.

In accordance with the second aspect, a mixing fixture is mounted on an end of the elongated cooling element such that the mixing fixture is positioned in a central portion of the liquid chamber. The mixing fixture includes a cone-shaped upper surface having a pointed end extending toward the second opening of the body, and a series of grooves formed in a base portion of the cone-shaped upper surface for efficiently mixing the powdered substance and liquid when the hollow member is rotated into the second position. Because the mixing fixture is mounted on the cooling element, which is detachable, the mixing fixture is easily and conveniently removed for cleaning after each use.

The present invention will be more fully understood in view of the following description and drawings.

DETAILED DESCRIPTION

The present invention is directed to beverage containers typically used for mixing powdered nutritional or dietary substances with a cooled liquid. In the embodiment disclosed below, the various aspects of the present invention are incorporated into a multi-chambered container similar to that disclosed in co-owned U.S. Pat. No. 5,678,709, which is incorporated herein in its entirety.

Figure 1:
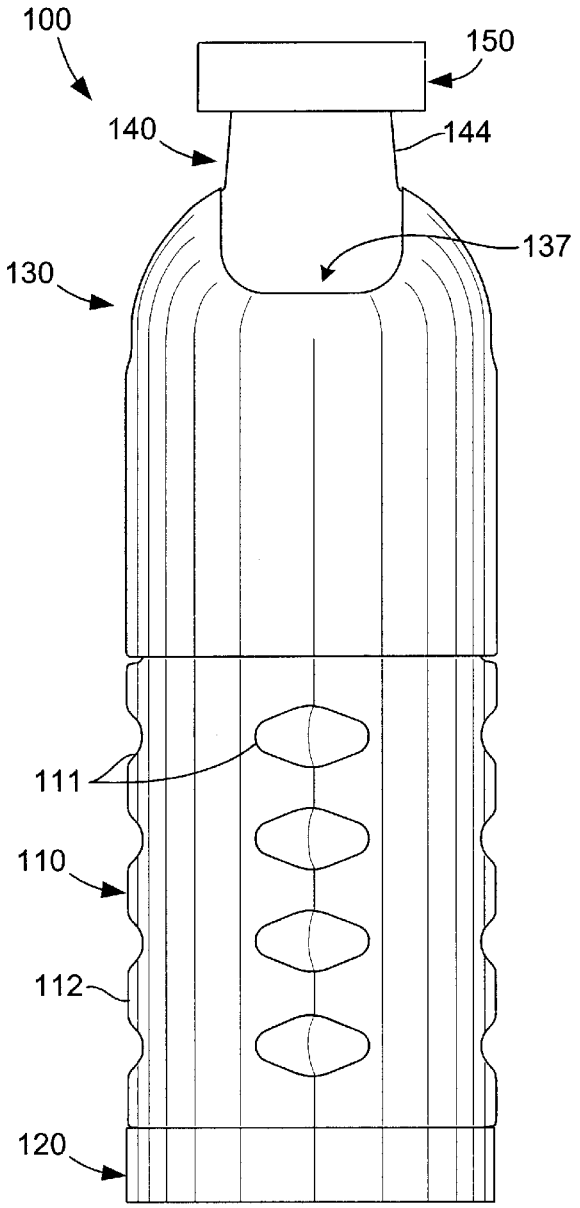
FIG. 1 is a front elevation view showing a multi-chambered container according to a first embodiment of the present invention.

FIG. 1 is a front elevation view showing a multi-chambered beverage container 100 according to an embodiment of the present invention. Multi-chambered container 100 includes a substantially cylindrical base 110, a detachable lower cap 120 connected to a lower (first) end of base 110, a dome-shaped housing 130 connected to a second (upper) end of base 110, a hollow member 140 mounted in housing 130, and a detachable upper cap 150 mounted on an upper portion of 130. Base 110 is formed with a series of indentations 111 formed in an outer wall 112 to facilitate handling. Hollow member 140 includes a neck 144 that extends through an upper opening of housing 130. As described in detail below, housing 130 includes a slot 137 that allows hollow member 140 to rotate relative to housing 130, thereby allowing powder stored in hollow member 140 to mix with liquid stored in body 110.

Figure 2:
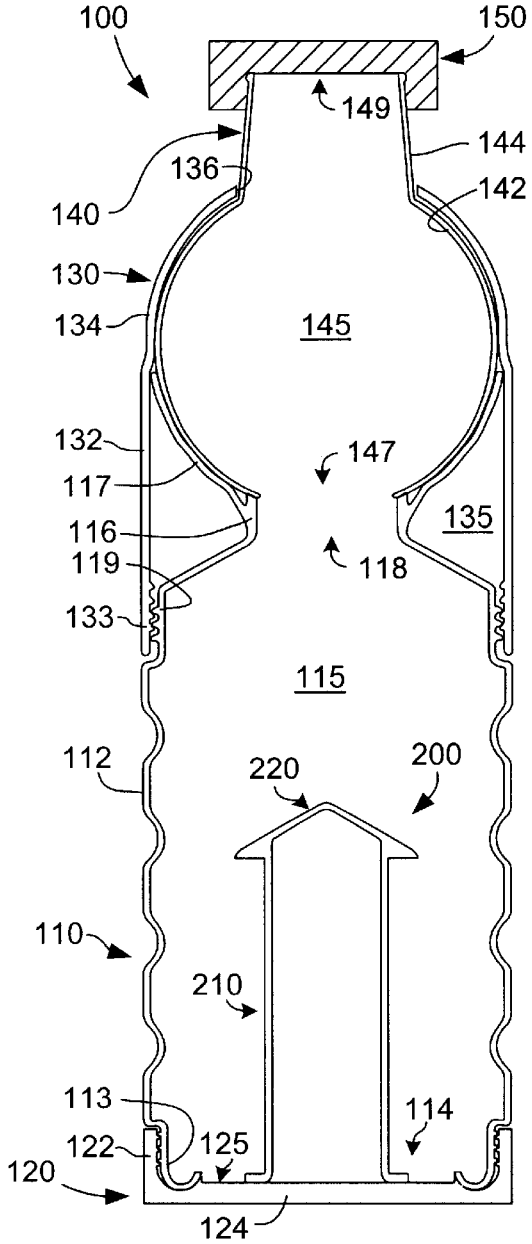
FIG. 2 is a cross-sectional front view showing the multi-chambered container of FIG. 1.

FIG. 2 is a cross-sectional front view showing multi-chambered beverage container 100 in additional detail.

Referring to the lower half of FIG. 2, outer wall 112 of body 110 includes a threaded lower end 113 that defines a lower (first) opening 114 communicating with a central chamber 115. Located at the upper end of wall 112 is a neck 116 having a flange 117 mounted thereon which define an upper (second) opening 118. A second set of threads 119 are formed on wall 112 below neck 116. As set forth below, central chamber 115 is utilized to store a liquid (not shown) prior to a mixing with a powdered substance.

Lower cap 120 includes a cylindrical outer wall 112 that has threads for detachable connection with threaded lower end 113 of body 110. Lower cap 120 also includes a disk-shaped cover plate 124 that covers lower opening 114 of body 110 when lower cap 120 is mounted thereon.

Housing 130 includes an outer wall 132 having threads 133 provided at a lower end thereof, and a domed or curved upper portion 134. Housing 130 defines a interior portion 135 for holding hollow member 140 against flange 117 of body 110. An upper opening 136 is formed in curved upper portion 134 that includes slot 137 (shown in FIG. 1).

Hollow member 140 includes a spherical (curved) wall 142 having neck 144 extending from and upper end thereof. Hollow member 140 defined a powder (second) chamber 145 that is used to store, for example, powdered nutritional or dietary substances (not shown). Hollow member defines a lower (third) opening 147 and an upper (fourth) opening 149 for communicating with powder chamber 145.

Upper cap 150 mounts on neck 144 to selectively cover upper opening 149 of hollow member 140.

In accordance with the present invention, lower cap 120 includes a cooling/mixing assembly 200 mounted on an inner surface 125 of disk-shaped cover plate 124 such that cooling/mixing assembly 200 extends into central chamber 115 of body 110. In the disclosed embodiment, cooling/mixing assembly 200 includes an elongated cooling element 210 and a mixing fixture 220. In an alternative embodiment (not shown), elongated cooling element 210 is provided without mixing fixture 220. In yet another alternative embodiment, mixing fixture 220 is mounted on an elongated element that does not provide a cooling function.

Figure 3A:
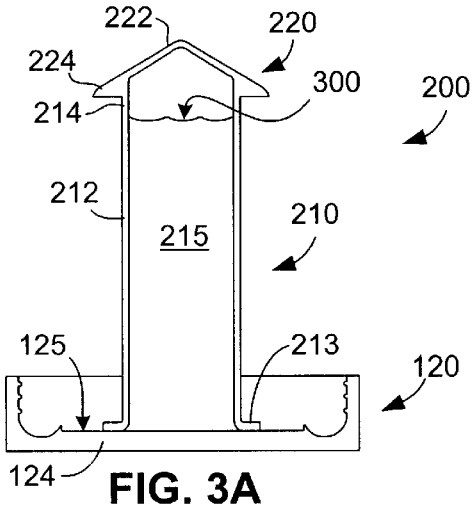
FIGS. 3A and 3B are cross-sectional and top views of a lower cap assembly of the multi-chambered container of FIG. 1.
Figure 3B:
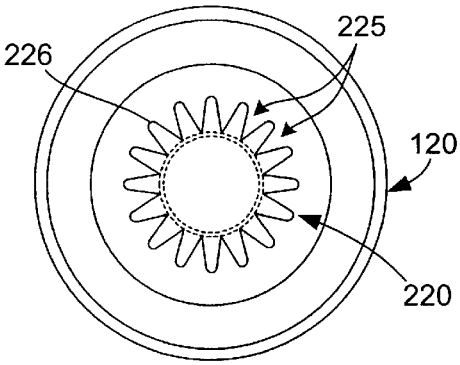

FIGS. 3A and 3B are cross-sectional and top views, respectively, of lower cap 120.

Referring to FIG. 3A, elongated cooling element 210 includes a cylindrical wall 212 having a lower flange 213 attached (e.g., sonically welded) to inner surface 125 of disk-shaped cover plate 124. Elongated cooling element includes an interior chamber used to store a coolant 300 (e.g., a mixture of 10% propylene glycol and 90% water).

In accordance with a first aspect of the present invention, lower cap 120 and elongated cooling element 210 are detached for from body 110 (see FIG. 1) for convenient cleaning and charging (e.g., freezing). That is, if cooling element 210 were integrally formed inside body 110, then cleaning central chamber 115 would be difficult, and charging cooling element 210 would require a substantially greater amount of space in, for example, a refrigerator/freezer in order to accommodate body 110. After charging, lower cap 120 is re-attached to body 110 immediately before a liquid is poured into central chamber 115. Because elongated cooling element 210 extends into body 110 and is surrounded by the liquid, a highly efficient heat exchange system is formed that maximizes the cooling capabilities of elongated cooling element 210.

Referring to the upper portion of FIG. 3A, mixing fixture 220 is integrally formed on upper end 214 of elongated cooling element 210, and includes a cone-shaped upper surface 222 having wide base portion 224. As shown in FIG. 3B, mixing fixture 220 is formed with a series of grooves 225 that form fingers 226.

In accordance with a second aspect of the present invention, mixing fixture 220 is mounted on end portion 214 of elongated cooling element 210 such that mixing fixture 220 is positioned in a central portion of central chamber 115 (as shown in FIG. 1). Note that any elongated element (e.g., one that does not provide a cooling function) may be used to position mixing fixture 220 in central chamber 115. By positioning mixing fixture 220 in this manner, a mixing (shearing) action produced by grooves 225 and fingers 226 is maximized that efficiently mixes powdered substances and liquids placed in body 110. Further, because mixing fixture 220 is mounted on elongated cooling element 210, which is detached from body 110 with lower cap 120, mixing fixture 220 is easily and conveniently removed for cleaning after each use.

Figure 4:
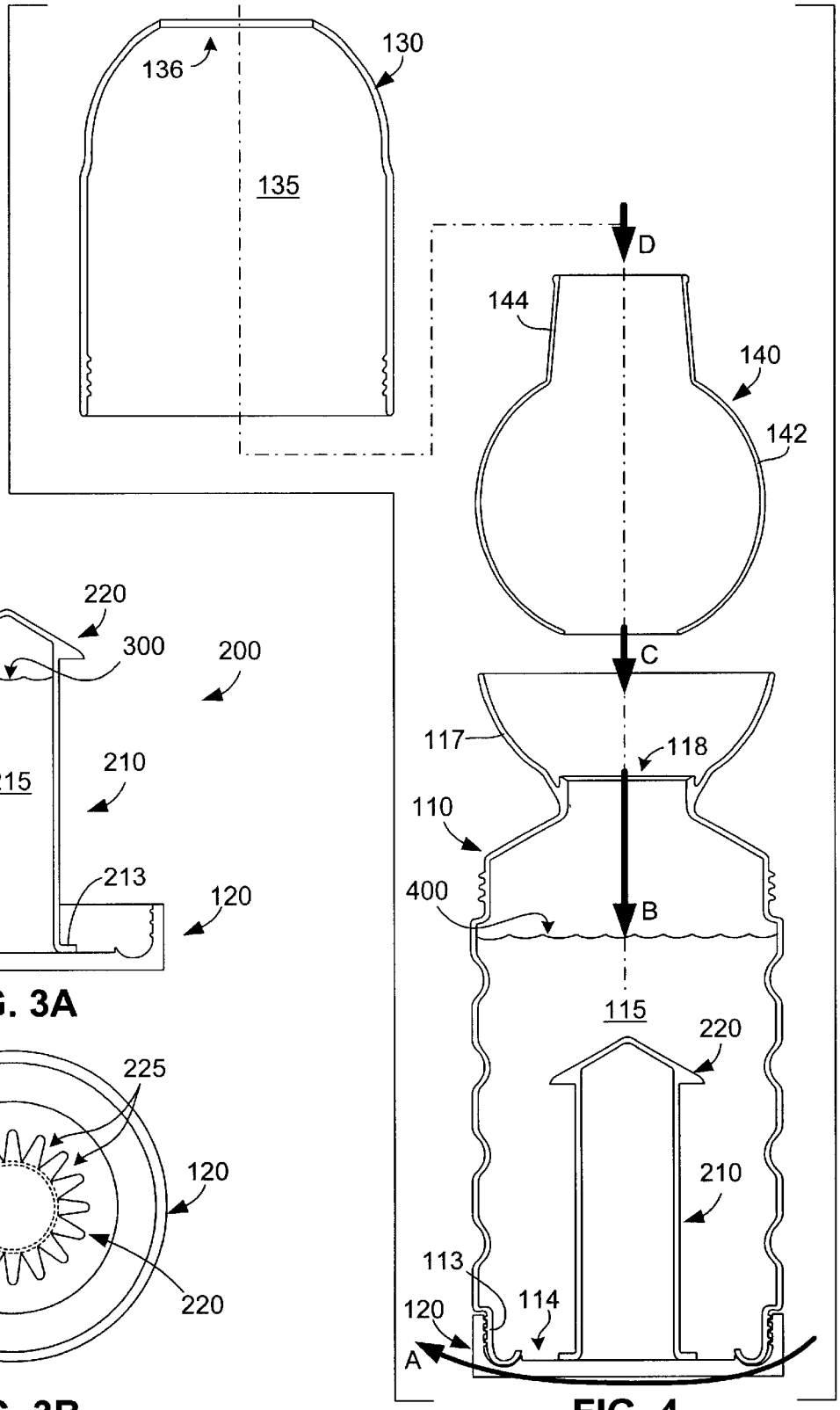
FIG. 4 is an exploded cross-sectional side view showing the multi-chambered container of FIG. 1 during an assembly process.

FIG. 4 is an exploded cross-sectional side view illustrating an assembly procedure utilized to prepare multi-chambered container 100 for use. As described above, elongated cooling element 210 is charged by placing lower cap 120 in a refrigerator/freezer (not shown) for an appropriate period of time (e.g., overnight). Upon removal from the refrigerator/freezer, lower cap 120 is mated with the threads provided on lower end 113 of body 110 and rotated in the direction indicated by arrow A, thereby sealing lower opening 114. Next, a fluid (e.g., water) 400 is inserted into central chamber 115 through upper opening 119 (as indicated by arrow B). Hollow member 140 is then placed onto flange 117 (arrow C), and then housing 130 is mounted over hollow member 140 (arrow D) such that spherical wall 142 is received in interior portion 135, and neck 144 extends through upper opening 136.

Figure 5:
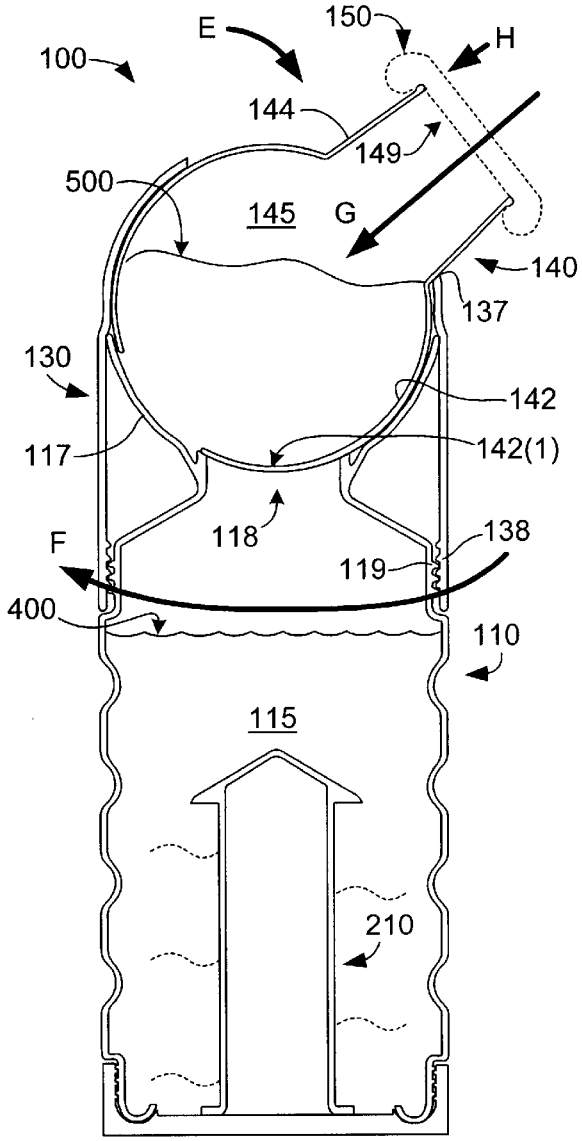
FIG. 5 is a cross-sectional side view showing the multi-chambered container of FIG. 1 in a closed position.
Figure 6:
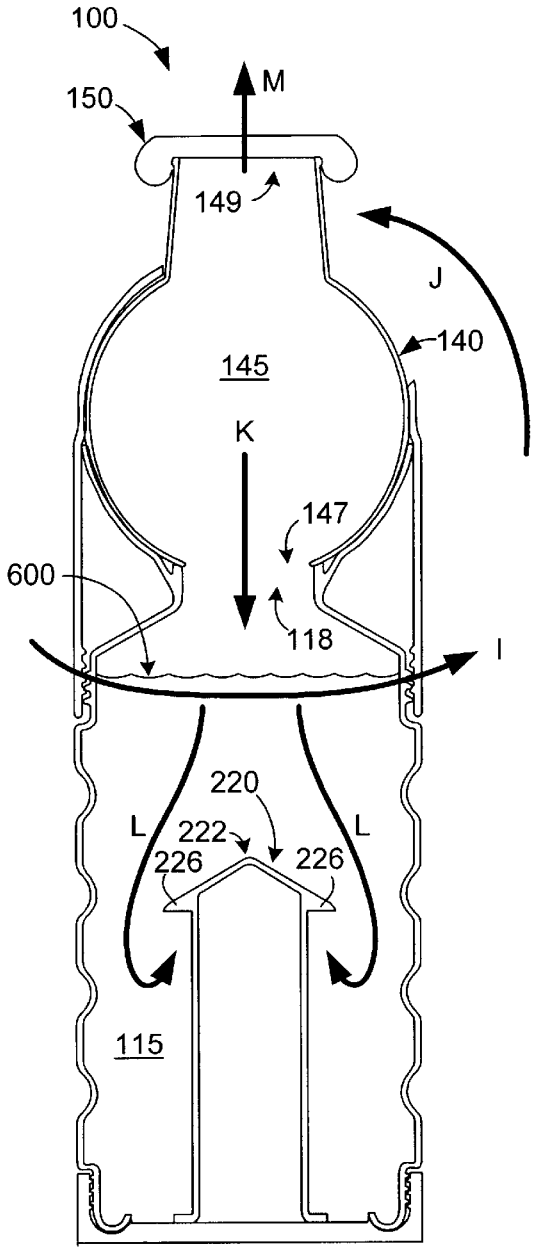
FIG. 6 is a cross-sectional side view showing the multi-chambered container of FIG. 1 in an open position.

FIGS. 5 and 6 are cross-sectional side views showing multi-chambered container 100 in a closed position and an open position, respectively. In the closed position shown in FIG. 5, hollow member 140 is positioned in housing 130 such that a portion 142(1) of spherical (curved) wall 142 is positioned over opening 118 to prevent mixing of a powdered substance 500 with liquid 400. In the open position shown in FIG. 6, hollow member 140 is rotated such that lower (third) opening 147 is aligned with upper (second) opening 118 to allow powdered substance 500 to enter central chamber 115 for mixing with liquid 400.

Referring to FIG. 5, multi-chambered container 100 is placed in the closed position by rotating hollow member 140 downward (indicated by arrow E) into slot 137 (also shown in FIG. 1). Housing 130 is then rotated relative to body 110 (arrow F) such that the threads 119 and 138 force housing 130 downward onto hollow member 140, which in turn presses hollow member 140 against flange 117. Accordingly, hollow member 140 is "locked" in the closed position by frictional contact with flange 117. Powdered substance 500 is then inserted through upper opening 149 into powder chamber 145 (arrow G), and then upper cap 150 is mounted on neck 144 to seal upper opening 149 (arrow H).

When assembled as shown in FIG. 5, multi-chambered container 100 can be conveniently transported to a desired location (e.g., a gymnasium or work location) with liquid 400 maintained in a cooled state by elongated cooling element 210.

FIG. 6 illustrates steps performed to mix powdered substance 500 with liquid 400 without exposing either to potential contaminants. First, housing 130 is rotated relative to body 110 (arrow I), thereby loosening hollow member 140 such that it can be manually rotated upward (arrow J). By rotating hollow member 140 in this manner, lower opening 147 is aligned with upper opening 118, thereby forming a passage that allows the contents of powder chamber 145 to enter central chamber 115 (arrow K). The thus-opened container 100 is then shaken to form a mixture 600 of powdered substance and liquid. Note that mixing element 220 is positioned such that mixture 600 is forced outward by cone-shaped upper surface 222, and is subjected to shearing force by fingers 226 (see FIG. 3B), thereby providing an efficient mixing process. Upper cap 150 is then removed and mixture 600 is poured through hollow member 140 and upper opening 149.

In addition to the specific embodiments disclosed herein, other containers incorporating the various aspects of the present invention are also possible. For example, the cooling element and/or mixing fixture may be incorporated in a single chamber container. Moreover, although the present invention has been described with reference to beverage containers used for mixing a cooled liquid and nutritional or dietary powdered substances, a container incorporating one or more of the aspects according to the present invention may be modified to store any substances that require cooling and/or mixing before use. In view of the modifications mentioned above and other possible modifications that fall within the spirit and scope of the present invention, the invention is limited only by the following claims.

What is claimed is:

1. A beverage container comprising:

a body defining a central chamber for storing a liquid, the body including a first opening and a second opening communicating with the central chamber; and a lower cap assembly detachably connected over the first opening of the body, the lower cap assembly including: a disk-shaped cover plate; and an elongated cooling element having a first end connected to a central portion of the disk-shaped cover plate and a second end extending perpendicular to the disk-shaped cover plate, wherein the elongated cooling element extends into the central chamber of the body such that the elongated cooling chamber is surrounded by the liquid stored in the central chamber, and wherein an interior chamber of the cooling element is filled with a coolant.

2. The beverage container according to claim 1 further comprising a hollow member defining a second chamber for storing a powdered substance, the hollow member including a curved wall and having a third opening and a selectively sealable fourth opening, wherein the curved wall of the hollow member is moveable between a first position in which a portion of the curved wall is disposed to block the second opening of the body such that the liquid is separated from the powdered substance, and a second position in which the second opening aligns with the third opening to form a passage between the central chamber of the body and the second chamber of the hollow member such that the liquid forms a mixture with the powdered substance, and wherein the powdered substance is insertable through the fourth selectively sealable opening into the hollow member when the curved wall of the hollow member is in the first position.

3. The beverage container of claim 2, further comprising a housing adjustably connected to the body over the second opening, the housing defining an interior portion, wherein the hollow member is rotatably disposed in the interior portion when the housing is loosely connected the body, and wherein the hollow member is fixedly disposed in the interior portion when the housing is tightly connected to the bottle.

4. The beverage container of claim 3, wherein the body includes a flange surrounding the second opening for receiving the hollow member.

5. The beverage container of claim 4, wherein at least a portion of an outer surface of the curved wall is spherical, and the flange includes a spherical surface formed to receive the hollow member such that when the housing is tightly connected to the body and the hollow member is in the first position, the hollow member is biased against the flange to seal the second opening of the body.

6. The beverage container of claim 4, wherein at least a portion of an outer surface of the curved wall is spherical, and the flange includes a spherical surface formed to receive the hollow member such that when the housing is tightly connected to the bottle and the hollow member is in the second position, the hollow member is biased toward the flange to form a seal around the passage formed by the first opening and the second opening.

7. An apparatus of claim 3 wherein the housing includes a slot, wherein the hollow member includes a neck protruding through the slot.

8. The beverage container according to claim 1, further comprising a mixing fixture connected to the second end of the elongated cooling element.

9. The beverage container according to claim 8, wherein the mixing fixture comprises a cone-shaped upper surface having a pointed end extending toward the second opening of the body.

10. The beverage container according to claim 9, wherein the mixing fixture defines a plurality of grooves formed in a base portion of the cone-shaped upper surface.

11. The beverage container according to claim 1, wherein the coolant comprises a mixture of 10% propylene glycol and 90% water.

12. A beverage container comprising:

a body defining a central chamber for storing a liquid, the body including a first opening and a second opening communicating with the central chamber; and a lower cap assembly detachably connected over the first opening of the body, the lower cap assembly including:

a disk-shaped cover plate;

an elongated element having a first end connected to a central portion of the disk-shaped cover plate and a second end extending perpendicular to the disk-shaped cover plate; and a mixing fixture attached to the second end of the elongated element, wherein the elongated element extends into the body such that the mixing fixture is maintained at a central location of the central chamber.

13. The beverage container according to claim 12 further comprising a hollow member defining a second chamber for storing a powdered substance, the hollow member including a curved wall and having a third opening and a selectively sealable fourth opening, wherein the curved wall of the hollow member is moveable between a first position in which a portion of the curved wall is disposed to block the second opening of the body such that the liquid is separated from the powdered substance, and a second position in which the second opening aligns with the third opening to form a passage between the central chamber of the body and the second chamber of the hollow member such that the liquid forms a mixture with the powdered substance, and wherein the powdered substance is insertable through the fourth selectively sealable opening into the hollow member when the curved wall of the hollow member is in the first position.

14. The beverage container of claim 13, further comprising a housing adjustably connected to the body over the second opening, the housing defining an interior portion, wherein the hollow member is rotatably disposed in the interior portion when the housing is loosely connected to the body, and wherein the hollow member is fixedly disposed in the interior portion when the housing is tightly connected to the bottle.

15. The beverage container of claim 14, wherein the body includes a flange surrounding the second opening for receiving the hollow member.

16. The beverage container of claim 15, wherein at least a portion of an outer surface of the curved wall is spherical, and the flange includes a spherical surface formed to receive the hollow member such that when the housing is tightly connected to the body and the hollow member is in the first position, the hollow member is biased against the flange to seal the second opening of the body.

17. The beverage container of claim 15, wherein at least a portion of an outer surface of the curved wall is spherical, and the flange includes a spherical surface formed to receive the hollow member such that when the housing is tightly connected to the bottle and the hollow member is in the second position, the hollow member is biased toward the flange to form a seal around the passage formed by the first opening and the second opening.

18. The beverage container of claim 14, wherein the housing includes a slot, wherein the hollow member includes a neck protruding through the slot.

19. The beverage container according to claim 12, wherein the mixing fixture comprises a cone-shaped upper surface having a pointed end extending toward the second opening of the body.

20. The beverage container according to claim 19, wherein the mixing fixture defines a plurality of grooves formed in a base portion of the cone-shaped upper surface.

* * * * *